US007296852B2

(12) United States Patent
Huse

(10) Patent No.: US 7,296,852 B2
(45) Date of Patent: Nov. 20, 2007

(54) UPHOLSTERED SEAT

(75) Inventor: Ovie Clarence Huse, Mineral Wells, TX (US)

(73) Assignee: Moeller Marine Products, Twinsburg, OH (US)

( * ) Notice: Subject to any disclaimer, the term of this patent is extended or adjusted under 35 U.S.C. 154(b) by 235 days.

(21) Appl. No.: 11/126,646

(22) Filed: May 11, 2005

(65) Prior Publication Data

US 2005/0264057 A1 Dec. 1, 2005

Related U.S. Application Data

(60) Provisional application No. 60/570,051, filed on May 11, 2004.

(51) Int. Cl.
*A47C 31/02* (2006.01)
*A47C 31/11* (2006.01)

(52) U.S. Cl. ..... 297/228.11; 297/228.12; 297/218.1; 297/218.2; 297/218.3; 297/218.4; 297/218.5

(58) Field of Classification Search ..... 297/228.11, 297/228.12, 218.1, 218.2, 218.3, 218.4, 218.5
See application file for complete search history.

(56) References Cited

U.S. PATENT DOCUMENTS 3,632,164 A 1/1972 Radke
4,557,522 A 12/1985 Isikawa
4,693,511 A 9/1987 Seltzer et al. ..... 297/228.11
5,007,676 A 4/1991 Lien
5,234,252 A 8/1993 Wallach
5,806,925 A 9/1998 Hanley ..... 297/228.11
6,309,017 B1 10/2001 Middleton
6,592,181 B2 * 7/2003 Stiller et al. ..... 297/218.2
2007/0035165 A1 * 2/2007 Zahel ..... 297/228.11

* cited by examiner

*Primary Examiner*—Rodney B. White
(74) *Attorney, Agent, or Firm*—William H. Honaker; Dickinson Wright PLLC

(57) ABSTRACT

A seat assembly and method of fabricating the seat assembly including a cushion (20) with a groove (22), and a cover (24) having an inner surface (26) wherein at least one drawcord (28) threadingly extends through the inner surface (26). The drawcord (28) is threaded from the groove (22) and through the cushion (20) to a base (34) where it is attached. The cushion (20) is formed by injecting foam into a mold and over the base (34) to form the cushion (20) with the groove (22) aligned with a tube (36) integrally formed in the base (34). The tube (36) provides a passage between the groove (22) and a bottom (32) of the base (34) for the drawcord (28).

18 Claims, 3 Drawing Sheets

UPHOLSTERED SEAT

CROSS REFERENCE TO RELATED APPLICATION

This application claims the benefit of Provisional Patent Application Ser. No. 60/570,051, filed May 11, 2004, all of its contents incorporated herein in their entirety.

BACKGROUND OF THE INVENTION

1. Field of the Invention

The subject invention relates to a seat assembly, and more particularly, to a seat assembly having a cushion and a cover attached to the cushion.

2. Description of the Prior Art

Prior art discloses numerous ways of attaching seat covers to cushions. The simplest method is to attach the seat cover only to the underside of the seat cushion, as disclosed in U.S. Pat. No. 4,693,511 issued to Seltzer.

Alternatively, another commonly used method for attaching seat covers is to use a dual-tongue seat cover. The dual-tongue seat cover is placed over a seat cushion portion and a separate seat back portion wherein a transverse section of the cover lies adjacent the crevice between the seat cushion and the seat back as disclosed in U.S. Pat. No. 5,150,947 issued to Croshaw.

Yet, another method of attaching seat covers incorporates anchoring means into the production of a cushion so that the anchor means are only secured by the foam cushion and are not directly attached to the vehicle cushion frame. The anchor means float in isolation from each adjacent anchor means in the foam cushion This method is disclosed in U.S. Pat. No. 3,632,164 issued to Radke.

The opportunity remains for a new design of a seat assembly wherein the seat assembly provides a cost effective and a more secure attachment of the cover to the seat assembly.

SUMMARY OF THE INVENTION AND ADVANTAGES

The present invention provides a seat assembly comprising a cushion with a plurality of grooves. A cover has an inner surface with a plurality of drawcords threadingly extending through the inner surface.

The invention is distinguished by threading the drawcords from the grooves through the cushion to a bottom surface of the cushion.

The present invention further includes a method of fabricating the seat assembly by injecting foam into a mold and over a base to form the cushion with a groove therein aligned with a tube extending upwardly from the base whereby the tube provides a passage between the groove and the bottom of the base through which the drawcord may be threaded.

The present invention provides a new design of a seat assembly wherein the seat assembly provides a cost effective and a more secure attachment of the cover to the seat assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
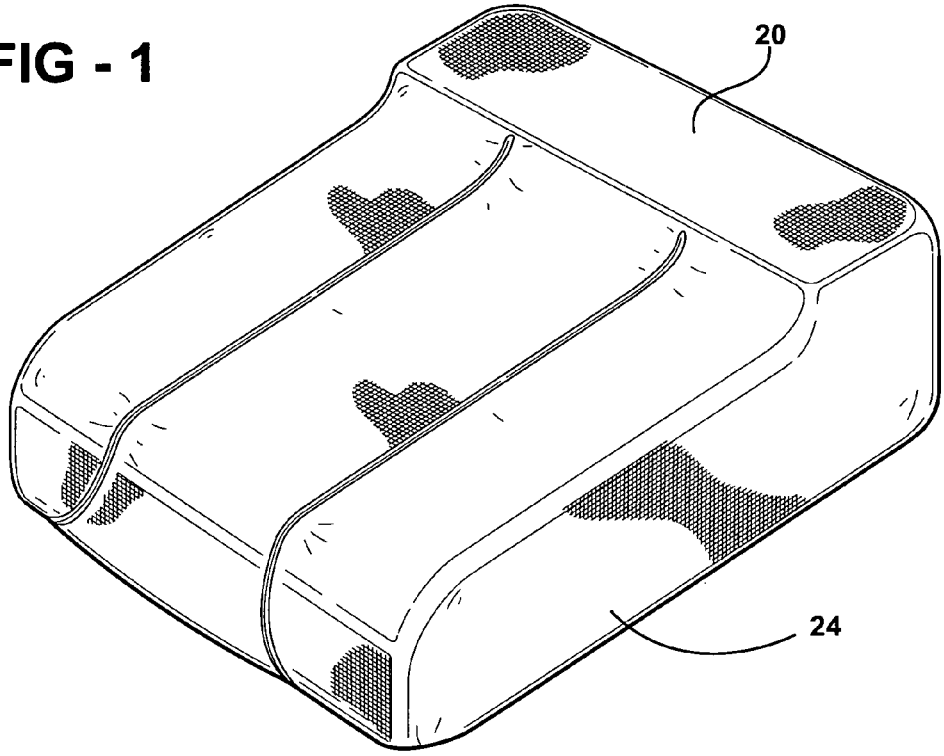
FIG. 1 is a plan view of a cushion assembly of the present invention.
Figure 2:
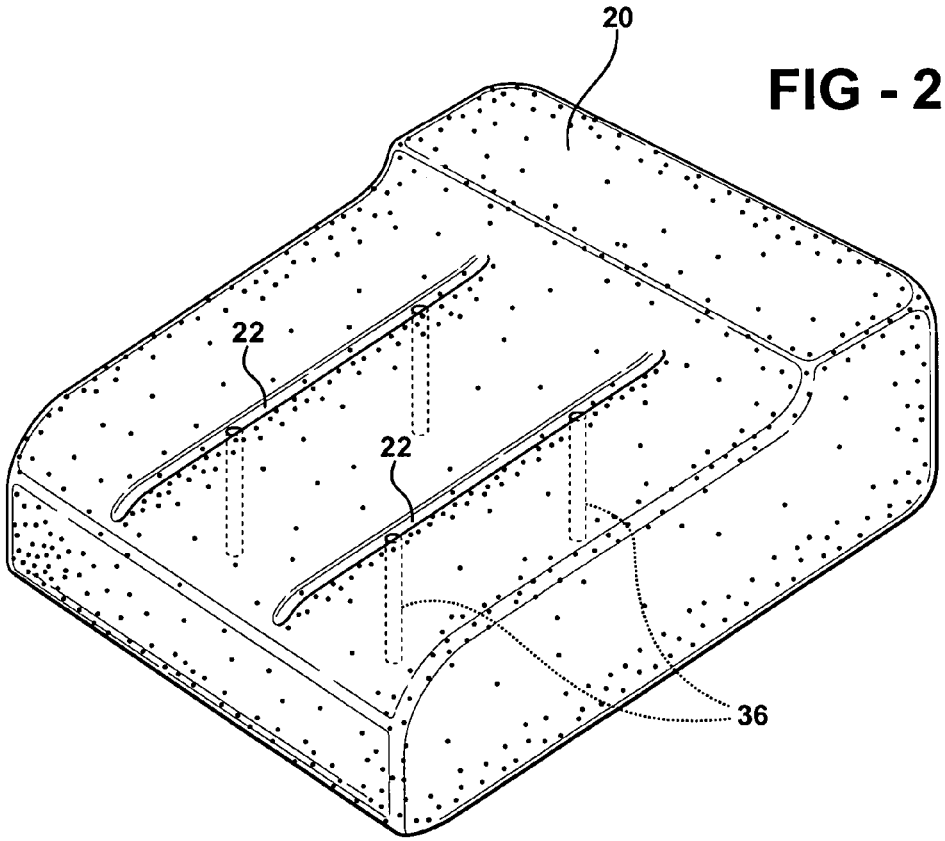
FIG. 2 is a plan view of a top surface of a cushion used with the assembly shown in FIG. 1.
Figure 3:
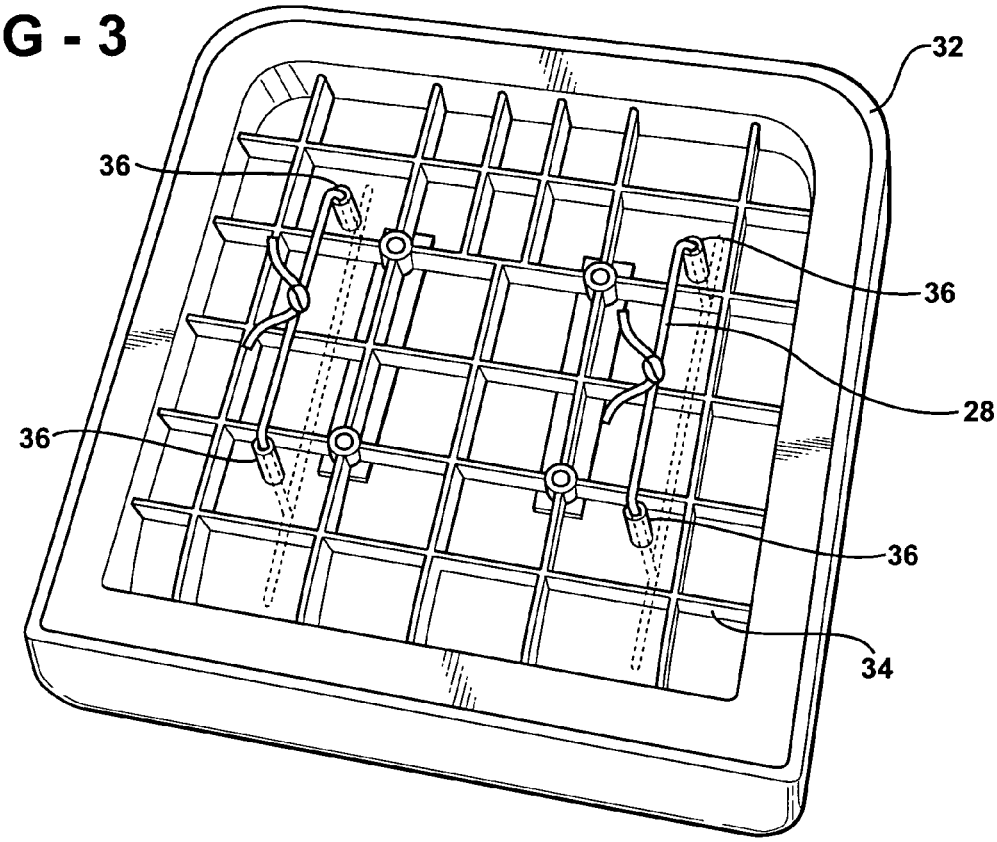
FIG. 3 is a perspective view of a bottom surface of a base used with the assembly shown in FIG. 1.
Figure 4:
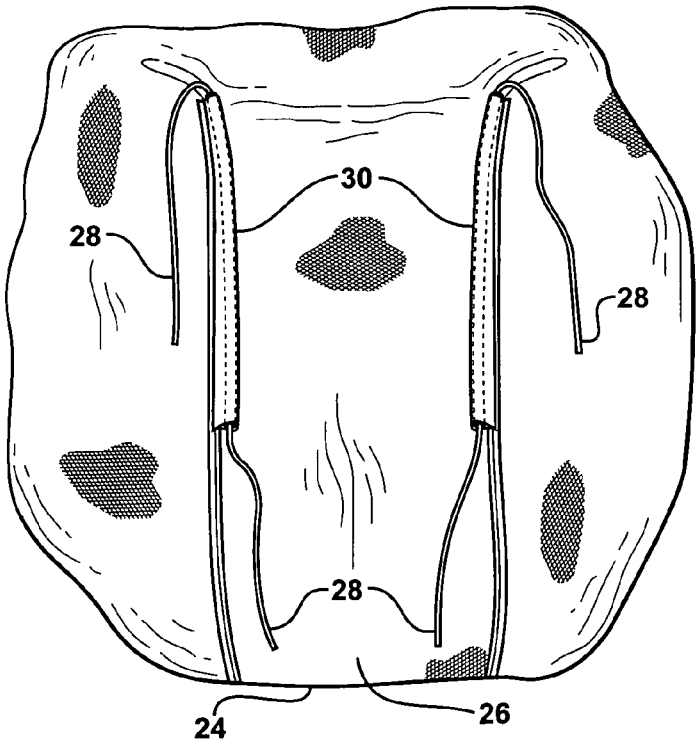
FIG. 4 is a perspective view of an inner surface of a cover used with the assembly shown in FIG. 1.
Figure 5:
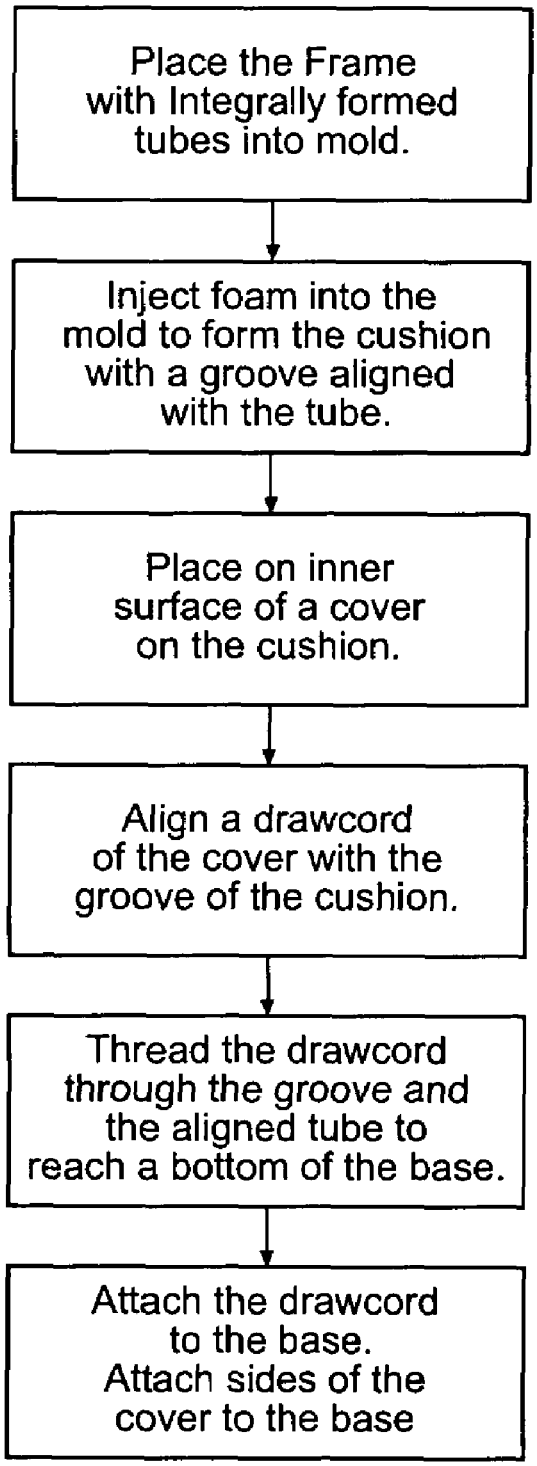
FIG. 5 is a block diagram for fabricating and assembling the assembly shown in FIGS. 1-4.

A seat assembly includes a cushion 20 formed of a resilient foam with a plurality of grooves 22. As appreciated by those skilled in the art, numerous design variations can be used by varying the grooves 22, contours and colors of the seat.

The assembly also includes a cover 24 having an inner surface 26 with a plurality of drawcords 28 threadingly extending through the inner surface 26. More specifically, the inner surface 26 of the cover 24 further includes a plurality of loops 30 for holding the drawcords 28. The drawcords 28 and their corresponding loops 30 are positioned so that they will be received within the grooves 22 of the cushion 20. It should be appreciated by those in the art, that the loops 30 can be other securing mechanisms, by example only and not meant to be limiting, channels, or tunnels, etc., could be used in place of the loops 30.

The assembly is distinguished by a drawcord 28 being threaded from the lower end of each groove 22 and through the cushion 20 to a bottom 32 of the cushion 20. Various methods may be used to perform the threading process, such as but not limited to, threading the drawcords 28 into the groove 22 of the cushion 20 with needles so that the cushion 20 can be punctured and the thread pulled by the needle through the cushion 20.

The assembly includes a base 34 wherein a tube 36 extends through the cushion 20 from the groove 22. The drawcord 28 extends through the tube 36. In the assembly, the base 34 and the tube 36 are integrally formed, and wherein the drawcord 28 is attached to the base 34. After this attachment the cover 24 is secured to the base 34.

The present invention also includes a method of assembling the seat including the steps of placing an inner surface 26 of the cover 24 over the top of the cushion 20 and aligning each drawcord 28 with one of the grooves 22.

The method is distinguished by threading the drawcord 28 from the lower end of the groove 22 in the cushion 20 and through the cushion 20 to a bottom 32 of the cushion 20.

The next step of the method includes holding the drawcord 28 with at least one loop 30 on the inner surface 26 of the cover 24. This step is subsequently followed by the step of threading the drawcord 28 through a tube 36 integrally formed with a base 34, wherein the tube 36 extends from the groove 22 of the cushion 20 to the bottom 32 surface of the cushion 20. Then the method includes pulling the drawcord 28 tightly through the tube 36 and attaching the drawcord 28 to the base 34. The remaining steps of the method include wrapping sides of the cover 24 around the cushion 20 and securing the sides of the cover 24 to the base 34.

The present invention also further includes a method of fabricating a seat including the step of placing a base 34 into a mold with at least one of the tubes 36 extending upwards from the lower face of the base 34.

The method is distinguished by injecting foam into the mold and over the base 34 to form the cushion 20 with each groove 22 aligned with at least one tube 36 whereby the tube 36 provides a passage between the groove 22 and the lower face of the base 34.

The next step in the method includes placing an inner surface 26 of a cover 24 over the upper surface of the cushion 20 and threading a drawcord 28 held with at least one loop 30 on the inner surface 26 of the cover 24 through the tube 36 extending from the groove 22 to the lower face of the base 34. Then the method includes pulling the drawcord 28 tightly through the tube 36 and attaching the drawcord 28 to the base 34. The method concludes by wrapping sides of the cover 24 around the cushion 20 and securing the sides of the cover 24 to the base 34.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

ELEMENT LIST

| Element Symbol | Element Name |
|---|---|
| 20 | cushion |
| 22 | grooves |
| 24 | cover |
| 26 | inner surface |
| 28 | drawcords |
| 30 | loops |
| 32 | bottom |
| 34 | base |
| 36 | tube |

What is claimed is:

1. A method of assembling a seat of the type including a cushion (20) with a plurality of grooves (22), and a cover (24) having an inner surface (26) with a plurality of drawcords (28) threadingly extending through the inner surface (26), said method comprising the steps of:

placing an inner surface (26) of the cover (24) over the top of the cushion (20) and aligning the drawcords (28) with the grooves (22); and threading the drawcord (28) through a tube (36) extending from the groove (22) of the cushion (20) to the bottom (32) of the cushion (20).

2. A method as set forth in claim 1 further defined as holding each drawcord (28) with at least one loop (30) on the inner surface (26) of the cover (24).

3. A method as set forth in claim 2 further defined as forming a base (34) integral with the tube (36).

4. A method as set forth in claim 3 further defined as pulling the drawcord (28) tightly through the tube (36) and attaching the drawcord (28) to the base (34).

5. A method as set forth in claim 4 further defined as wrapping sides of the cover (24) around the cushion (20).

6. A method as set forth in claim 5 further defined as securing the sides of the cover (24) to the base (34).

7. A method of fabricating a seat of the type including a cushion (20) with a a plurality of grooves (22), and an upper surface, said method comprising the steps of:

placing a base (34) into a mold with at least one tube (36) extending upwards from the bottom (32) of the base (34), and characterized by injecting foam into the mold and over the base (34) to form the cushion (20) with the grooves (22) being aligned with the tubes (36) whereby the tubes (36) provide a passage between the grooves (22) and the lower face of the base (34).

8. A method as set forth in claim 7 further defined as placing an inner surface (26) of a cover (24) over the upper surface of the cushion (20).

9. A method as set forth in claim 8 further defined as threading a drawcord (28) through the tube (36) extending from the groove (22) to the lower face of the base (34) to secure the cover (24) to the base (34).

10. A method as set forth in claim 9 further defined as holding the drawcord (28) with at least one loop (30) on the inner surface (26) of the cover (24).

11. A method as set forth in claim 10 further defined as pulling the drawcord (28) tightly through the tube (36) and attaching the drawcord (28) to the base (34).

12. A method as set forth in claim 11 further defined as wrapping sides of the cover (24) around the cushion (20) and securing the sides of the cover (24) to the base (34).

13. A seat assembly comprising:

a cushion (20) with a plurality of grooves (22), a cover (24) having an inner surface (26) with a plurality of drawcords (28) threadingly extending through said inner surface (26), and characterized by said drawcords (28) being threaded through said grooves (22) of said cushion (20) to a bottom (32) of said cushion (20), and at least one tube (36) extending through said cushion (20) from said groove (22) for said drawcord (28) being threaded through said tube (36).

14. An assembly as set forth in claim 13 wherein said inner surface (26) of said cover (24) further includes a plurality of loops (30) for holding said drawcords (28).

15. An assembly as set forth in claim 13 wherein said drawcord (28) extends through said tube (36).

16. An assembly as set forth in claim 15 including a base (34) integral with said tube (36) and wherein said drawcord (28) is attached to said base (34).

17. An assembly as set forth in claim 16 wherein the cover (24) is secured to said base (34).

18. A seat assembly comprising:

a cushion (20) with a plurality of grooves (22) and an upper surface, a base (34) having a lower face with at least one tube (36) extending upwards from the lower face of the base (34), and characterized by said grooves (22) being aligned with said tubes (36) to provide a passage between said grooves (22) and said lower face of said base (34).

* * * * *